United States Patent [19]

Chao

[11] Patent Number: 5,071,071

[45] Date of Patent: Dec. 10, 1991

[54] AERATOR STRUCTURE FOR A WATER FAUCET

[76] Inventor: Tien-Hsiung Chao, P.O. Box 96-405, Taipei 10098, Taiwan

[21] Appl. No.: 533,580

[22] Filed: Jun. 5, 1990

[51] Int. Cl.[5] ..... E03C 1/08

[52] U.S. Cl. ..... 239/428.5; 239/533.1

[58] Field of Search ..... 239/428.5, 570, 533.1, 239/553, 590, 553.5, 459, 590.5; 261/DIG. 22; 138/46

[56] References Cited

U.S. PATENT DOCUMENTS

| | | | |
|---|---|---|---|
| 2,316,135 | 4/1943 | Turek et al. | 239/428.5 |
| 2,896,863 | 7/1959 | Shames et al. | 239/428.5 |
| 2,902,224 | 9/1959 | Shames et al. | 239/428.5 |
| 2,936,958 | 5/1960 | Shames et al. | 239/533.1 |
| 3,014,665 | 12/1961 | Shames et al. | 239/428.5 |
| 3,104,819 | 9/1963 | Aghnides | 239/428.5 |
| 3,450,350 | 6/1969 | Gullaksen . | |
| 3,684,190 | 8/1972 | Bletcher et al. | 239/428.5 |
| 4,221,335 | 9/1980 | Shames et al. | 239/553 |
| 4,313,564 | 2/1982 | Shames et al. | 239/428.5 |
| 4,562,960 | 1/1986 | Marty et al. | 239/428.5 |

*Primary Examiner*—Andres Kashnikow
*Assistant Examiner*—Christopher G. Trainor

[57] ABSTRACT

It is an improved aerator structure for a water faucet, which mainly comprises an outer case, a vertical cylinder, a mixing member, a partition member, and an upper valve assembly; the upper valve assembly includes a spring, a post in the center thereof, and a mixing member of which the lower end is formed into a circular member to provide a guide function and distance-limiting function. Under a standard water supply pressure, the water volume can be maintained at minimum variation. The mixing member provides a water stream with bubbles. Sand particles or impurities would not be piled up on the upper valve assembly.

6 Claims, 4 Drawing Sheets

AERATOR STRUCTURE FOR A WATER FAUCET

BACKGROUND OF THE INVENTION

1. Field of the Invention

The present invention relates to an aerator, and particularly to an aerator for a faucet to maintain the water stream in a stable or minor variation condition upon the water pressure being varied.

2. Description of the Prior Arts

In the conventional aerators, the aerator usually has a housing and a straight cylinder being mounted in the housing. The inner surface of the housing has an annular flange for retaining the straight cylinder in place. Between the housing and the lower end of the straight cylinder, there is an annular air passage, of which the upper edge is furnished with through holes. The inside of the straight cylinder is furnished with a mixing body. After the water from the faucet flowing through the mixing body, the water will be converted into a water fall-shaped stream. The water stream and the air are to be mixed up after passing through the passage inside the straight cylinder and the notches on the edge of the straight cylinder. The lower end of the straight cylinder is furnished with vanes or a net member as a buffer to generate air bubbles in the water stream.

Generally, the straight cylinders in the prior art are not provided with any pressure control or stream volume control structure; consequently, the stream volume will be varied in proporation to the water pressure out of the faucet; it would be in-convenient to the user.

In another conventional aerator, it is designed for the purpose of saving water; the water volume of that aerator is designed and set at 2.8±10% G.P.M. (U.S. standard). In the straight cylinder or the upper end of the mixing body, there is a control device for adjusting the standard water volume of the faucet. The water volume control in the aerator is designed at a standard of 80 PSIG. Whenever the water pressure is lower than 80 PSIG, the volume of water stream will be reduced immediately. Whenever the water pressure is lower than 20 PSIG, the volume of water stream would be reduced to a condition to become useless.

Still another conventional aerator has a flat upper valve element mounted on the upper end of the straight cylinder. The upper valve element has a suitable rib-shaped water passage to let the water stream flow in a scattered direction so as to have the water mixed up with the air in the mixing body to generate bubbles in the water stream. Since the upper valve element is a still part, any sands or impurities in the water might be accumulated on the top flat surface thereof; in that case, the water passage would be blocked to some extent to reduce the flow rate of water. Further, the accumulated sands or impurities might, after a long time, give rise to germs or the like to cause a sanitation problem.

A further conventional aerator has such an upper valve element on the upper end of the straight cylinder that the lower center part of the upper valve element has a post extended to the round base in the lower center part of the straight cylinder, and the lower end of the post has an annular rim; by means of the hydrodynamic pressure effect of the straight cylinder on the outside of the aerator, any sands or impurities may not be accumulated on flat surface of the upper valve element. The aforesaid prior art was disclosed in a U.S. Pat. No. 4,562,960, which is used to maintain the water clean; however, the post extended out of the faucet is usually neglected by the user without being moved manually; as a result, sands or impurities are still accumulated in the aerator of the faucet.

In the current aerator for the water faucet, the aerator developed in U.S. Pat. No. 4,562,960 is deemed the best aerator, which would cause the water stream in a faucet to have less variation; that aerator is so designed that it generates no resistance to the water stream; when it is attached to different type of faucets, the water stream would have considerable variation.

SUMMARY OF THE INVENTION

In view of the drawback of the prior arts, the inventor has developed the present invention, "An Improved Aerator Structure for A Water Faucet", which can minimize the water stream variation on condition that the water stream is at 2.8±10% and the water pressure is ranging from 20 PSIG to 80 PSIG.

The prime object of the present invention is to provide an improved aerator structure, in which the partition member has a first diameter hole and a bevel surface for mounting an upper valve assembly thereon. The upper valve assembly has an annular flange and a bevel contact surface; the aforesaid two parts and a bevel surface on the partition member can provide a function of regulating the water stream to flow into the aerator. Under the first cylinder in the partition member, there are a second cylinder and a plurality of salient blocks; a plurality of recesses are arranged regularly between every two salient blocks. The upper valve assembly also has a cylindrical body and a conical portion for providing a water passage between the upper valve assembly and the partition member. The cylindrical post of the upper valve assembly has an annular groove, in which a spring is mounted to provide support function therefor. The lower part of the upper valve assembly has a post extending downwards, and the lower end of the post is formed into a semicircular shape with a slot and a retaining flange. The post is to be mounted in a round hole of a mixing member, and the post can move up and down within a given distance limited by the retaining flange.

Another object of the present invention is to provide an improved aerator structur, in which the annular flange of the upper valve assembly is furnished with a plurality of slots; the inner upper wall of the partition member has a first cylinder and a bevel surface, both of which and the annular flange and the bevel contact surface on the upper valve assembly form a variable space from the slots upon the water pressure varying so as to regulate the water stream volume automatically.

Still another object of the present invention is to provide an improved aerator structure, in which the space variation between the slots of the upper valve assembly and the first cylinder on the partition member is achieved by means of an annular groove in the upper valve assembly and a spring therein, an inner socket in the mixing member, and the cylindrical post of the upper valve assembly, which also provide a guide function for the movement of the upper valve assembly upon the water pressure varying.

A further object of the present invention is to provide an improved aerator structure, in which the upper valve assembly is provided with a plurality of slanting slots, which form, together with a first cylinder and a bevel surface, a first water passage. A plurality of recesses are furnished under a second cylinder in the partition member; the recesses and a cylindrical body and a conical portion of the upper valve assembly form a second water passage. Between the first water passage and the second water passage, there is a second cylinder, which is buffer zone for the water stream so as to maintain the water stream to have less variation curve between the upper valve assembly and the partition member upon the water pressure varying.

A still further object of the present invention is to provide an improved aerator structure, in which the upper valve assembly has a pressure surface and a pressure conical surface; a plurality of slots are provided on the pressure conical surface. The upper valve assembly is installed with a spring so as to let the upper valve assembly move up and down within a given space upon the water pressure varying; the aforesaid structure can also prevent sand particles or impurities from being accumulated on the upper valve assembly; otherwise, the water passage may be blockaded more or less.

DESCRIPTION OF THE PREFERRED EMBODIMENT

Figure 2:
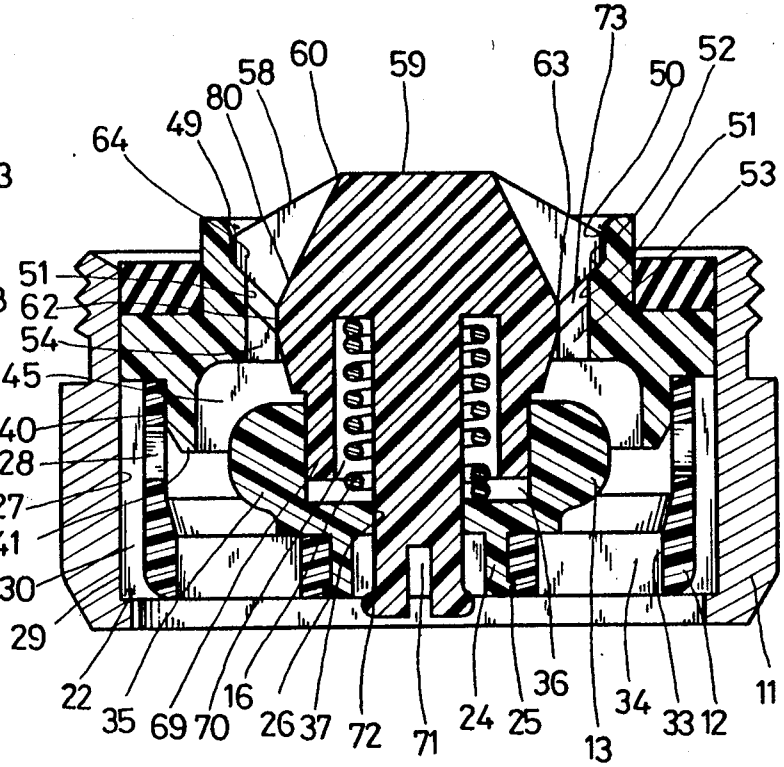
FIG. 2 is a sectional view of the present invention, showing the faucet being set at the minimum water volume position.

Referring to FIGS. 1 to 5, the improved aerator structure according to the present invention comprises mainly an outer case 11, a vertical cylinder 12, a mixing member 13, a partition member 14, an upper valve assembly 15 and a spring 16. The lower end center of the upper valve assembly 15 is provided with a post 17 to be mounted with a spring 16. Between the upper valve assembly 15 and the partition member 14, there are a bevel contact surface and a water passage. The post 17 of the upper valve assembly 15 is to penetrate the center hole of the partition member 14 and to be movably retained in the round hole 18 of the mixing member 13. The mixing member 13 is movably mounted in the vertical cylinder 12. Since the upper valve assembly 15 is mounted with a spring 16, the contact surface and the water passage between the upper valve assembly 15 and the partition member 14 will be adjusted appropriately upon the outer case 11 of the present invention being mounted on a faucet, and upon the water pressure being varied; in other words, the water volume between the upper valve assembly and the partition would not be varied greatly.

The outer case 11 is formed into a round hollow cylinder, of which the upper end has outer threads 21 so as to have the present invention screwed and engaged with the inner threads of a water faucet. The lower and inner end of the outer case 11 has an inner flange 22, on which the vertical cylinder 12 is rested. The vertical cylinder 12 has a round hole 23 in the center thereof for receiving the cylindrical portion 24 of the mixing member 13. The lower end of the cylindrical portion 24 has an annular flange 25. An annular groove 26 is provided in the lower part of a round hole 23 of the vertical cylinder 12. Both the annular flange 25 and the annular groove 26 can be mated each other when they are molded so as to be engaged each other properly.

The lower inner end of the outer case 11 is provided with an inner flange 22, on which the vertical cylinder 12 is rested. The vertical cylinder 12 is designed for mounting the mixing member 13 and the partition member 14 therein, and also for aeration. The vertical cylinder 12 is a hollow cylindrical member with several rectangular apertures 28 on the wall thereof; several projected blocks 29 are provided between every two rectangular apertures respectively. The projected blocks 29 are to rest on the inner flange 22 in the outer case 11, and the outer surface of the projected blocks 29 is in contact with the inner surface 27 of the outer case 11. Since the outer diameter of the rectangular aperature 28 surface is less than the inner diameter of the inner flange 22, several air passages 30 are provided between the vertical cylinder 12 and the outer case 11; therefore, air can flow through the rectangular aperture to generate aeration function upon the water flowing.

The upper rim 13 of the vertical cylinder 12 is used for mounting the partition member 14. Between the circular ring 32 and the inner surface 33 of the vertical cylinder 12, there are a plurality of radial vanes 34. The circular ring 32 also forms a round holes 23, of which the lower end has a annular groove 26 to be mated with the annular flange 25 of the cylindrical portion 24.

The mixing member 13 has a cylindrical portion in the lower end thereof to be mounted in the round hole 23 of the vertical cylinder 12. The upper part of the mixing member 13 is formed into a disk member 35 with an inner socket 36 and a round hole 37; the round hole 37 is in communication with the socket base 38 under the lower end of the cylindrical portion of the mixing member. The inner socket 36 and the round hole 37 are used to receive the post 17 with a spring 16 after the partition member 14 and the upper valve assembly 15 are mounted in place so as to provided a movable space for the upper valve assembly upon the water pressure being varied and to control the water volume. After the cylindrical portion 24 of the mixing member is mounted in the vertical cylinder 12, the water flowing down from the partition member 14 would flow over the disk member 35 in a spread and even manner so as to let the water flow through the rectangular apertures 28 to generate an aerated condition.

Figure 3:
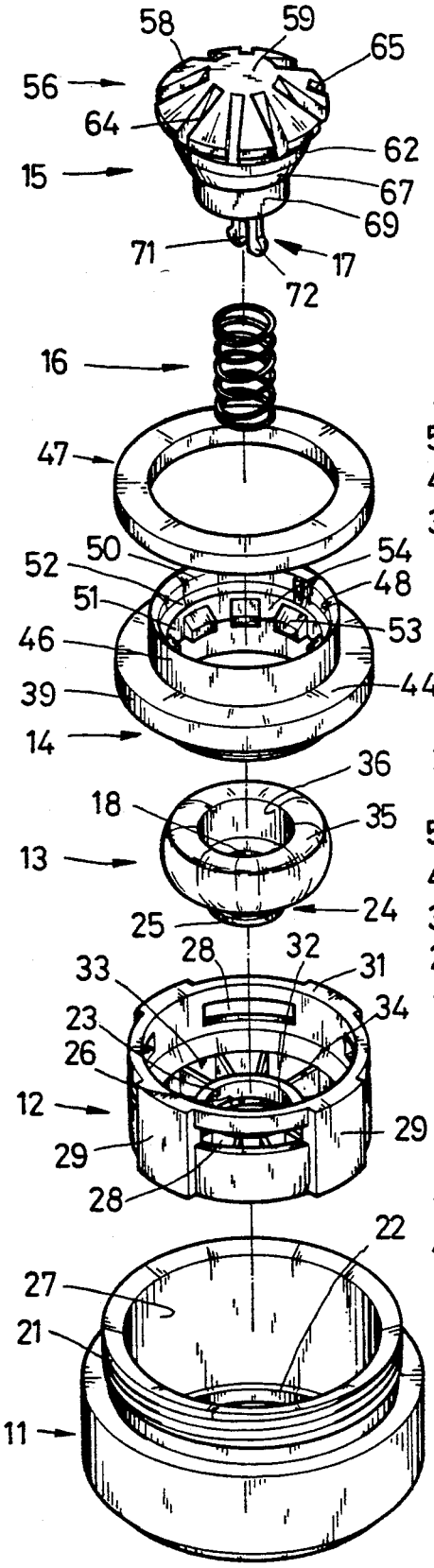
FIG. 3 is a disassembled view of the present invention.

The partition member 14 is mounted on the upper rim 31 of the vertical cylinder 12 by means of an outer flange 39, and then the lower outer surface 40 of the partition member 14 will extend downwards in the visinity of the rectangular aperature 28. The bottom edge 41 of the partition member 14 has a bevel edge 42, whereby the rectangular apertures 28 are to be maintained in open condition to let the air flow freely so as to be mixed up with water flowing there through to provide an aeration function. The inner surface 43 of the partition member 14 extends upwards to the upper surface 44 of the partition member; the space between the inner surface 43 and the disk member 35 is formed into a water passage 45 to let water flow downwards; when the water is flowing through the bottom edge 41, the water will be mixed up with air to generate bubbles therein. The upper outer surface 46 of the partition member 14 is a vertical cylindrical part to facilitate a ring washer 47 to be mounted thereon so as to seal the water upon the present invention being attached to a water faucet. The upper inner surface 48 of the partition member 14 has a round edge 49. Under the round edge 49, there are a first cylinder 50 and a second cylinder 51; there is a bevel surface 52 between the first cylinder 50 and second cylinder 51. Under the second cylinder 51, there is a round portion being provided with a plurality of salient blocks 53 and recesses 54 disposed regularly each other as shown in FIG. 3. The space between the recesses 54 and the upper valve assembly 15 forms a first water passage 73, which can maintain the water at a constant stream upon the water pressure varying.

Figure 4:
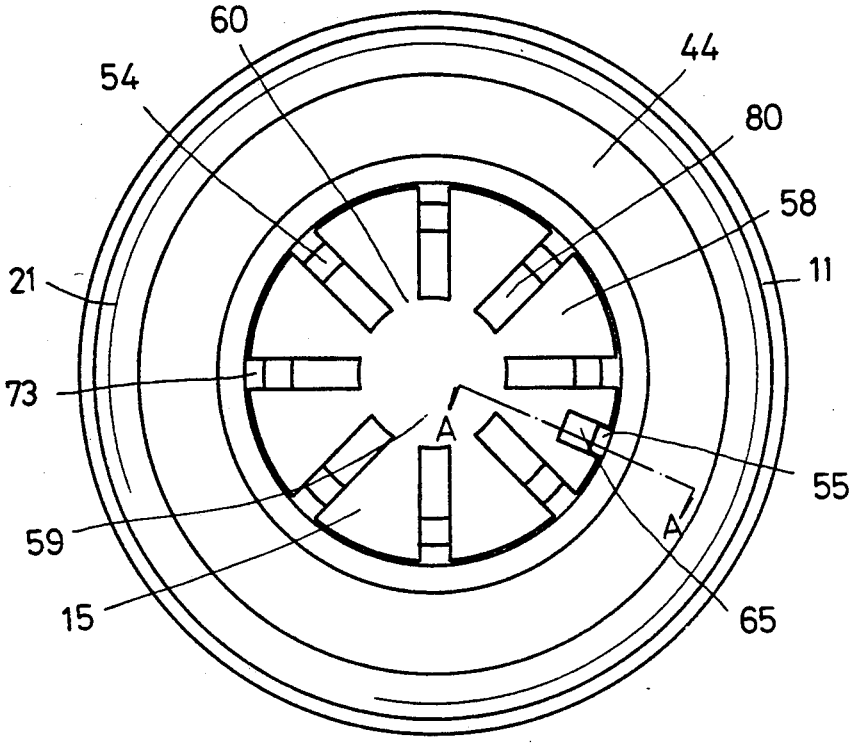
FIG. 4 is a top view of the present invention, showing the installation of the upper valve assembly in the present invention.
Figure 5:
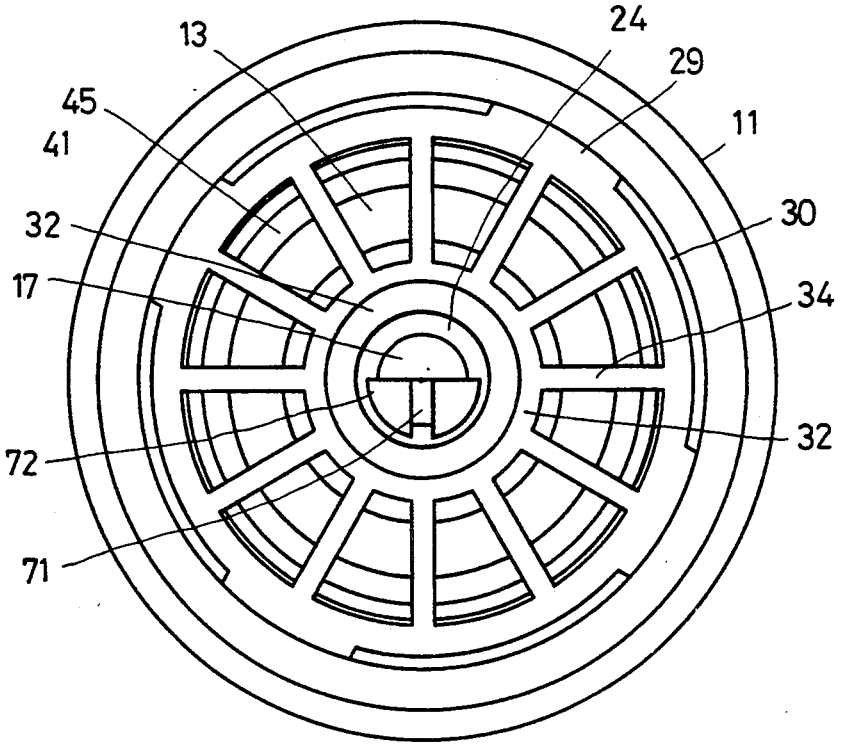
FIG. 5 is a bottom view of the present invention, showing the installation of the vertical cylinder in the present invention.
Figure 10:
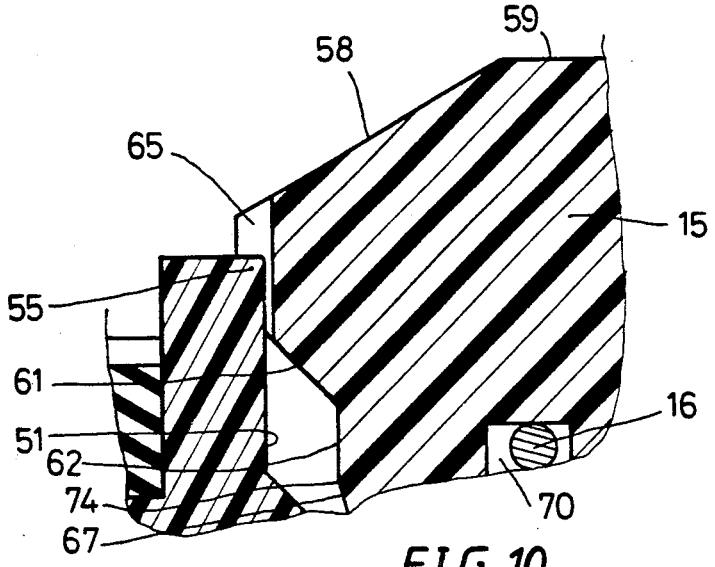
FIG. 10 is a fragmental section view taken along line A—A in FIG. 4.

Since the partition member 14 has been provided with salient blocks 53 and recesses 54, the upper valve assembly 15 also has the corresponding parts as shown in FIGS. 4 and 10 so as to provide a water passage. The first cylinder 50 of the partition member 14 has a guide key 55 to let the upper valve assembly 15 move up and down only without rotation upon the water pressure varying.

The upper valve assembly 15 is mounted in the center of the partition member 14; the upper portion 56 of the upper valve assembly 15 includes an annular flange 57 adjacent to the first cylinder 50. Above the annular flange 57, there is a pressure conical surface 58. A pressure surface 59 is furnished above the conical surface 58. There is an upper pressure edge 60 between the pressure conical surface 58 and the pressure surface 59. Under the annular flange 57, there is a bevel contact surface 61. Both the annular flange 57 and the bevel contact surface 61 are designed to be in contact with the first cylinder 50 and the bevel surface 52 to provide an adjustment effect for the water stream. There is a lower pressure edge 63 between the bevel contact surface 61 and the cylindrical body 62 of the upper valve assembly 15. The outer diameter of the cylindrical body 62 is equal to the inner diameter of between two opposite salient blocks 53 of the partition member as shown in FIG. 10. The annular flange 57 is provided with a plurality of slots 64 arranged regularly; the slots 64 are provided in symmetrical manner with the recesses 54 in the partition member 14. The annular flange 57 has a guide slot 65, which is to be engaged with the guide key 55 in the partition member so as to guide the upper valve assembly to move up and down. The annular flange 57 of the upper valve assembly is provided with a plurality of slots 64 extended from the upper pressure edge 60 to the lower pressure edge 63. The slots 64 are designed as a water passaged for a basic stream.

The upper valve assembly 15 extends downwards from the lower edge 66 to form into a conical portion 67, which is to be rested at the level of the salient blocks 53 in the partition member 14, being in contact with the upper edge 74 only. A second water passage 68 is formed between the conical portion 67 and the recesses 54 of the vertical cylinder 12; through that water passage 68, the water stream is guided into the water passage 45 on the upper part of the mixing member 13 so as to generate a water stream with bubbles.

The lower part of the upper valve assembly 15 has a cylindrical post 69 under the conical portion 67; the cylindrical post 69 is to be rested in the inner socket 36 of the mixing member 13. In the cylindrical post 69, there is an annular groove 70 for mounting a spring 16 therein. The center of the cylindrical post 69 has a post 17, of which the end is formed into a semicircular post with a slot 71 and a retaining flange 72 so as to facilitate the post 17 to fit flexibly into the round hole 37 in the mixing member 13. By means of the spring 16 inside the annular groove 70 and the retaining flange 72 on the lower end of the post 17, the upper vavle assembly 15 is provided with a space to move up and down so as to control the water stream upon the water pressure being varied.

Since every water faucet has its water-flow coefficient, the water stream passing through the aerator structure would be different. When the present invention is mounted to a water faucet, the upper valve assembly 15 would move to a suitable position as a result of its novel structure and a given water pressure so as control the water stream at a supply level desired.

Figure 1:
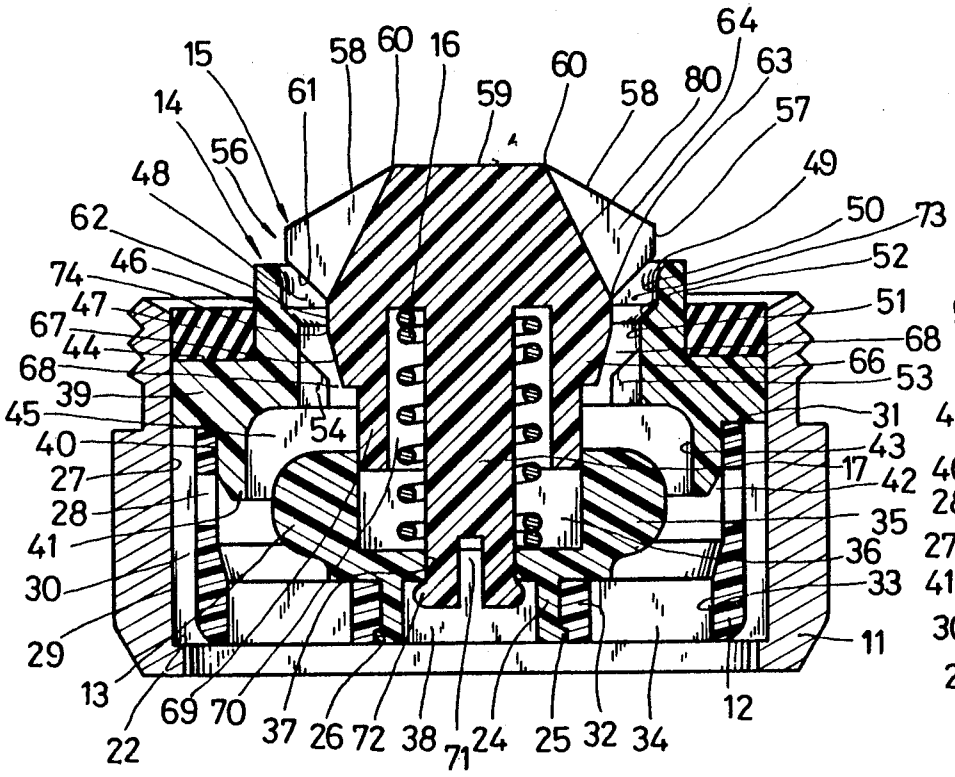
FIG. 1 is a sectional view of an embodiment according to the present invention, showing the faucet being set at the maximum water volume position.

Referring to FIG. 1, it shows that when the present invention is mounted on a water faucet having a lowest water pressure (i.e., 20 PSI), that pressure will be unable to cause the upper valve assembly 15 to move downwards; in that case, the upper valve assembly 15 will be pushed upwards to the highest point by the spring 16. The highest point is limited by the displacement of the post 17 and the position of the retaining flange 72. The water first flows into the first water passage 73 formed with the slots 64 on the upper valve assembly 15 and the first cylinder 50 and the bevel surface 52; then, the water will flow into the second water passage 68 formed with the cylindrical body 62 and the conical portion 67 of the upper valve assembly 15, and the recesses 54 and the second cylinder 51 of the partition member 14; finally, the water flows into the water passage 45 of the mixing member 13 to mix with the air in the air passage 30 to generate bubbles.

Figure 9:
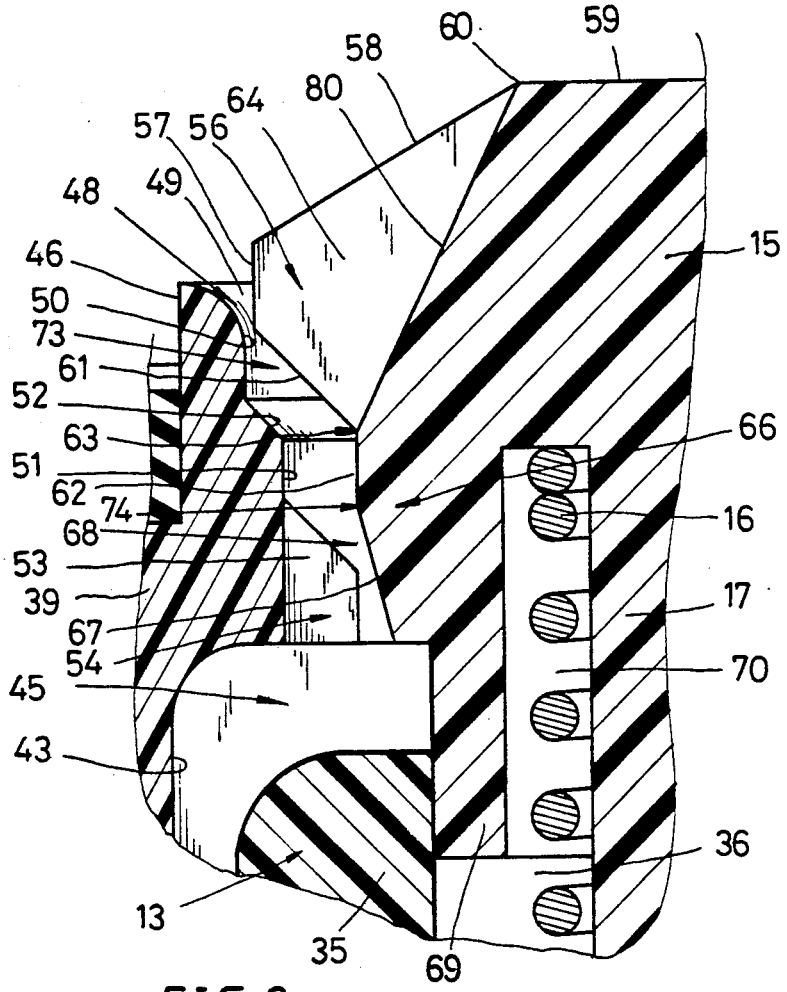
FIG. 9 is a fragmental section view, showing the condition of the water passage therein.

When the water pressure varies; the upper valve assembly 15 will be lifted up at a given height by means of the spring 16 so as to maintain the water stream at a given volume. As shown in FIGS. 1, 2 and 9, the water pressure usually exerts on the pressure surface 59, the pressure conical surface 58 of the upper valve assebbly, and the bevel surface 80. When water stream flows through the upper valve assembly, the water will pass through the slots 64 on the pressure conical surface 58, and the first cylinder 50 of the partition member 14 and the bevel surface 52; since the aforesaid passage varies in space, the water volume will also be varied; in other words, When the water pressure reaches its maximum pressure, the bevel contact surface 61 of the upper valve assembly will be in contact with the bevel surface 52. The water stream can still flow through the slots 64 in a less volume as a result of the bevel contact surface 61 being closed. When the water pressure is slightly reduced, the upper valve assembly 15 will be lifted up at a suitable distance by the spring 16; then, the bevel contact surface 61 will not be in contact with the bevel surface 52, and the water volume flows through the slots 64 will be increased. When the water pressure is reduced to the lowest standard, the bevel contact surface 61 will not be in contact with the first cylinder 50, and then a maximum volume of water will flow through the first water passage 73; in that case, the space for water volume is almost equal to that between the first water passage 73 and the second water passage 68; in other words, that water passage is considered a buffer zone for maintaining the water at a suitable volume no matter the water pressure is high or low.

After the water flows through that buffer zone, the water enters into the second water passage 68, which is formed by means of the salient blocks 53 under the second cylinder 51, the recesses 54. When the water pressure varies, the water volume will vary in accordance with the space veriation between the conical portion 67 and the salient blocks 53 and the recesses 54 in the partition member; in other words, when the water pressure varies, the water stream in the first water passage 73 would be equal, in volume, to that in the second water passage 68.

After the water flows through the second water passage 68, the water stream will be spread evenly by the disk member 35 of the mixing member 13; after the water flows through the bottom edge 41 of the vertical cylinder 12, the air will flow through the air passage 30 and the rectangular aperture 28 to provide a venturi tube effect to have the water and the air mixed up to provide a water stream with bubbles.

Figure 6:
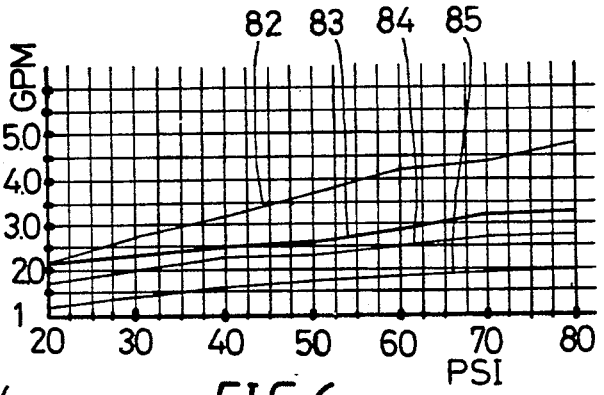
FIG. 6 is an experimental curve of the water stream when no faucet is installed.
Figure 7:
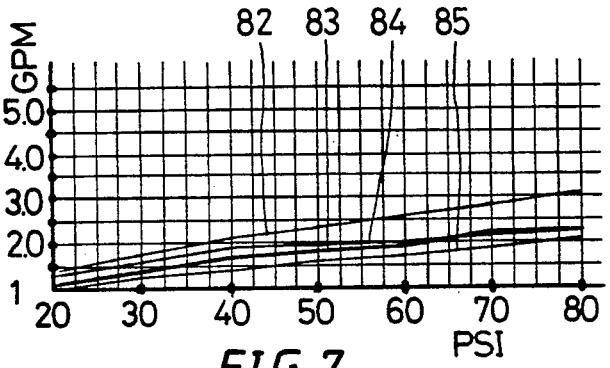
FIG. 7 is an experimental curve of the water stream when a faucet LK-4123 is installed.
Figure 8:
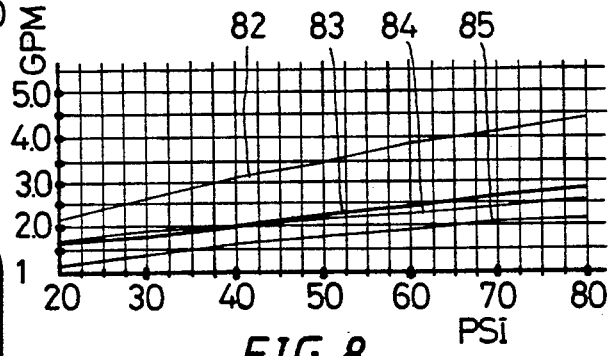
FIG. 8 is an experimental curve of the water stream when a faucet LK-2000 is installed.

The present invention has been tested and compared with the prior art of the kind as shown in FIGS. 6 to 8; for instance, FIG. 6 illustrates a curve to show the present invention being mounted to a cool water pipe without faucet; the curve 82 indicates the water stream condition when no aerator is attached thereto. The curve 83 indicates the present invention is attached thereto; the curve 84 indicates an aerator of U.S. Pat. No. 4,562,960 being attached thereto. The curve 85 indicates a water stream condition upon a RESTRICTED aerator being attached thereto. It is apparent, according to the aforesaid curves, that the water stream control varies in accordance with different aerator used upon the water pressure varying.

FIG. 7 illustrates an aerator being mounted on a water faucet of LK 4123 having a cool water supply; the curve 82 indicates the water stream condition when no aerator is attached thereto. The curve 83 indicates the present invention is attached thereto; the curve 84 indicates an aerator of U.S. Pat. No. 4,562,960 being attached thereto. The curve 85 indicates a water stream condition upon a RESTRICTED aerator being attached thereto. It is apparent, according to the aforesaid curves, that the water stream control varies in accordance with different aerator used upon the water pressure varying.

FIG. 8 illustrates an aerator being mounted on a water faucet of LK 2200 having a cool water supply; the curve 82 indicates the water stream condition when no aerator is attached thereto. The curve 83 indicates the present invention is attached thereto; the curve 84 indicates an aerator of U.S. Pat. No. 4,562,960 being attached thereto. The curve 85 indicates a water stream condition upon a RESTRICTED aerator being attached thereto. It is apparent, according to the aforesaid curves, that the water stream control varies in accordance with different aerator used upon the water pressure varying.

Briefly, the improved aerator according to the present invention can control the water stream volume by means of the first water passage and the second water passage formed between the upper valve assembly and the partition member; there is a buffer zone between the first and the second water passages. Further, when the water pressure varies, the water stream volume will be regulated automatically with the movement of the upper valve assembly caused by the spring in the upper valve assembly.

I claim:

1. An improved aerator structure for a water faucet comprising:

an outer cylindrical case having outer threads formed on an upper end thereof, and an inner flange formed on a lower end thereof;

a vertical cylinder having a cylindrical shape with several rectangular apertures formed on an upper wall thereof, a projected block being provided between every two said rectangular apertures, said rectangular apertures forming several air passages between said outer case and said vertical cylinder; a lower center of said vertical cylinder having a circular ring which is connected with a wall of said vertical cylinder by means of a plurality of radial vanes; and a first round hole formed in a center of said circular ring;

a mixing member, of which an upper part is a disk member with an inner socket and a second round hole formed in a center thereof; and said mixing member having a cylindrical portion formed in a lower end thereof to be mounted in said first round hole of said vertical cylinder;

a partition member having an outer flange, whereby said partition member is mounted on said vertical cylinder; a lower end of said partition member having a bevel edge, an outer wall surface of said partition member being in contact with an inner surface of said vertical cylinder; an upper inner surface of said partition member having a round edge; an inner surface of said partition member having a first cylinder and a second cylinder, a bevel surface being formed between said first cylinder and said second cylinder, a guide key being formed on said first cylinder, a plurality of salient blocks and recesses being provided and distributed below said second cylinder; and an inner lower part of said partition member being formed into a round recess whereby a water passage is formed;

an upper valve assembly including a first post to extend into said second round hole of said mixing member; a second cylindrical post being provided about said first post to be mounted in said inner socket of said mixing member; a first annular groove being formed between said second post and said first post; a conical portion and a cylindrical body formed above said second post opposite and close to an inner surface of said salient blocks and recesses; an upper part of said upper valve assembly having a pressure surface and a pressure conical surface; said pressure conical surface having a plurality of slots and a guide slot; a first annular flange of said upper valve assembly being mounted in said first cylinder of said partition member; a bevel contact surface being formed under said first annular flange; and said bevel contact surface being in contact with a lower part of said recesses; and a spring being mounted in said first annular groove of said upper valve assembly, and one end of said spring being rested in said inner socket of said mixing member.

2. An improved aerator structure for a water faucet as claimed in claim 1, wherein said cylindrical portion forms a socket base in a lower end of said second round hole of said mixing member.

3. An improved aerator structure for a water faucet as claimed in claim 1, wherein a second annular flange is formed on said lower end of said mixing member, a lower end of said circular ring has a second annular groove which is mated with said second annular flange of said mixing member.

4. An improved aerator structure for a water faucet as claimed in claim 1, wherein one end of said first post is formed into a semi-circular part having a slot and a retaining flange formed thereon.

5. An improved aerator structure for a water faucet as claimed in claim 1, wherein each of said slots of said upper valve assembly has a bevel inner surface; and when water pressure in said faucet is varied, a space between said slots of said upper valve assembly and said first cylinder of said partition member functions to regulate the water stream volume.

6. An improved aerator structure for a water faucet as claimed in claim 1, wherein said cylindrial body and said conical portion are formed below a lower side of said bevel contact surface of said upper valve assembly; and said cylindrical body and said conical portion, and said opposite salient blocks of said partition member form into a variable water passage upon the water pressure being varied.

* * * * *